United States Patent [19]

Blumenthal

[11] 4,198,923

[45] Apr. 22, 1980

[54] TONING APPARATUS FOR ELECTROSTATIC PRINTING AND PLOTTING MACHINES

[75] Inventor: John Blumenthal, Wickliffe, Ohio

[73] Assignee: Gould Inc., Rolling Meadows, Ill.

[21] Appl. No.: 903,855

[22] Filed: May 8, 1978

[51] Int. Cl.[2] ..... G03G 15/10

[52] U.S. Cl. ..... 118/660; 118/411; 118/412; 354/317

[58] Field of Search ..... 118/660, 411, 412; 134/64 P, 122 P; 354/317; 401/13, 34, 35, 261, 265; 101/366

[56] References Cited

U.S. PATENT DOCUMENTS

| | | | |
|---|---|---|---|
| 3,145,410 | 8/1964 | Stahl | 401/265 |
| 3,407,786 | 10/1968 | Beyer et al. | 118/660 |
| 3,474,757 | 10/1969 | Dreher | 118/411 |
| 3,651,782 | 3/1972 | MacDonald | 118/660 X |
| 3,664,298 | 5/1972 | Giaimo | 118/660 |
| 3,796,155 | 3/1974 | Schluckebier | 101/366 X |
| 3,929,099 | 12/1975 | Szymber et al. | 118/660 X |

*Primary Examiner*—Roland E. Martin, Jr.

*Attorney, Agent, or Firm*—Charles E. Snee, III; Russell E. Baumann

[57] ABSTRACT

A toner head is disclosed for applying liquid toner to a moving record medium having a latent electrostatic image thereon, in which the contact surface of the head is curved in a cylindrical form to ensure proper engagement of the record medium during toning. Since the toner is circulated through the system by a vacuum pump arrangement, pressure relief means are provided to prevent an inward deflection of the record medium that could choke off toner flow during periods when the record medium is not moving over the toner head. In one embodiment, the toner head comprises a plurality of identical modules which are oriented alternately in opposite directions, so that some serve as toner inlet stations and some as exhaust stations. A toner clean-off head having a cylindrically curved contact surface is also disclosed.

7 Claims, 13 Drawing Figures

TONING APPARATUS FOR ELECTROSTATIC PRINTING AND PLOTTING MACHINES

BACKGROUND OF THE INVENTION

In the electrostatic printing and plotting, or imaging, arts, various systems have been developed over the years in which a latent image first is electrostatically imparted to a moving record medium and then is developed or toned by the application of a toning material which adheres to the electrostatically produced latent image. Both dry and liquid toners have been used and each has been found to have its own peculiar characteristics, advantages and problems.

Of particular interest with regard to the present application are those systems in which liquid toners are used. U.S. Pat. No. 3,342,164 issued to Arthur M. Lewis and assigned to the assignee of this application, discloses a type of electrostatic toner head for use with liquid toner. The patentee taught the use of a head in which toner is pulled by vacuum into a developing or toning compartment bounded on one side by the record medium bearing the latent image to be developed. The partially depleted toner then left the compartment through a plurality of edge openings spaced across the moving record medium. The face of the toner head where contacted by the record medium was essentially flat; so that, to achieve an adequate seal between the toner head and the record medium, an internal pressure of at least 280 mm of mercury (11 inches) below the ambient atmospheric pressure was usually required. Maintaining such a pressure differential required the use of comparatively large, expensive pumping devices.

The clearance which must be maintained between the record medium and the counterelectrodes of the toning head in the active toning zones is usually quite small, ideally being in the order of a few thousandths of a centimeter. Since the record medium is essentially unsupported in the active toning zones, a large difference between the internal pressure of the toning zone and the ambient atmospheric pressure will limit greatly the allowable separation between the supporting members that establish the spaced relationship between the counterelectrodes and the latent image bearing side of the record medium. Other disadvantages caused by the rather large pressure differences applied in prior art toning heads are generation of higher drag forces to be overcome by the paper transport mechanism and acceleration of component wear rates to be overcome by frequent replacement or use of more expensive wear resistant materials.

Typically in liquid toned electrostatic systems, an excess of toner is applied to the record medium to ensure adequate development; then the excess is drawn away by some means and the record medium is allowed to dry. U.S. Pat. No. 3,654,659, issued to John Blumenthal, the present applicant, and also assigned to the assignee of the present application, discloses a type of liquid toner clean-off system for high speed operation. The wet record medium is drawn past an elongated suction opening which is just upstream of a narrow land lying in the same plane as the suction opening. Air is drawn over the land when suction is applied to the suction opening, thereby skimming excess toner from the record medium. While this technique has achieved a significant measure of success, the flat configuration of the clean-off head makes effective sealing with the record medium difficult, thereby requiring the use of rather high vacuum, as in the case of the toning head previously mentioned.

Those skilled in the art will appreciate that a need has existed for some time for a reliable toning head and toner clean-off head which do not rely on the use of high vacuum to ensure proper engagement between the head and the record medium. In addition, a simplified toner head geometry has been in demand. The present invention seeks to satisfy these needs.

OBJECTS OF THE INVENTION

An object of the invention is to provide an improved liquid toning system for use in electrostatic printers and plotters, in which a substantially smaller pressure differential will provide proper engagement between the record medium and the toning head and toner clean-off head.

A further object of the invention is to provide a toning system which facilitates precise alignment between the record medium and the toning head and ensures adequate engagement therebetween.

Another object of the invention is to provide an improved toning head and toner clean-off head which are simple to manufacture and install.

A still further object of the invention is to provide a toning head and a toner clean-off head which are less susceptible to abrasive wear and also less prone to changes in operating characteristics as wear occurs.

The above objects are given only by way of example. Thus, other desirable objects and advantages inherently achieved by the disclosed invention may become apparent to those skilled in the art. Nonetheless, the scope of the invention is to be limited only by the appended claims.

SUMMARY OF THE INVENTION

The above objects and other advantages are achieved by the disclosed invention which relates to an improved toner head for applying liquid toner to a record medium. The head comprises a housing having at least one inlet plenum and at least one outlet plenum for receiving fresh and depleted toner, respectively. Vacuum applied to the outlet plenum moves the liquid toner through the device. A manifold communicates with both plenums to direct toner flow therebetween via image development zones located in the manifold. The manifold, together with a pair of end caps, comprises a plurality of elongated, toning channels across which toner liquid flows in operation, the channels being laterally bounded by a plurality of outwardly extending wear rails and the outer side of the channels being bounded by the record medium resting on the rails, so that several narrow toning chambers or zones are formed. The bottoms of the elongated, toning channels are formed of electrically conductive material so that they function as counterelectrodes during the toning process. The outer edges of the wear rails or elements collectively comprise a portion of the geometrical elements of a cylindrical surface or face contour over which the record medium is drawn during toning. Because of the cylindrical face contour, an initial sealing pressure is provided by the wrap and tension of the record medium so that it conforms easily to the outer edges of the wear elements and other contacting lands, thereby ensuring good sealing engagement throughout the toning process, without requiring the application of high vacuum. A reduction in vacuum to about 76 mm of mercury (3.0 inches) is possible with the invention, compared to minimum of about 280 mm (11 inches) required in prior art, flat toning heads. Thus, alignment problems and drag forces, which promote paper transport difficulties and increase wear rates, are minimized.

The invention also concerns a toner clean-off head having a cylindrical contact surface which is self-regenerating under normal abrasive wear conditions and to which the record medium easily conforms to ensure proper removal of toner with a minimum of applied vacuum. Good toner clean off results have been achieved with an applied vacuum as low as 90 mm of mercury (3.5 inches), with some improvement in effectiveness up to about 150 mm of mercury (6 inches).

DETAILED DESCRIPTION OF THE PREFERRED EMBODIMENTS

Figure 1:
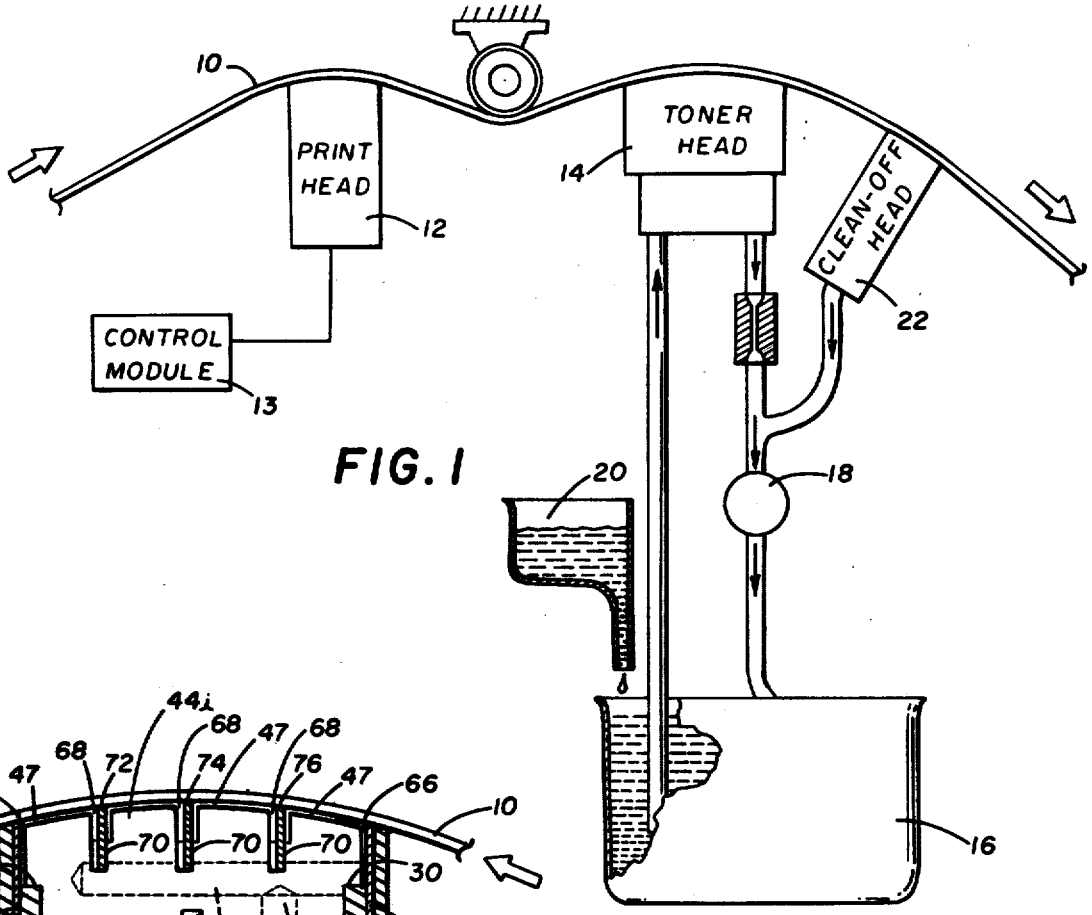
FIG. 1 shows a schematic arrangement of an electrostatic printer or plotter embodying the toning head and toner clean-off head according to the invention.

There follows a detailed description of the preferred embodiments of the invention, reference being made to the drawings in which like reference numerals identify like elements of structure in each of the several Figures.

FIG. 1 illustrates schematically the general layout of an electrostatic printer-plotter or similar imaging system embodying the invention. A record medium 10, such as a suitably treated paper, is drawn from a source, not shown, over an electrostatic printer head 12, which may be of the type disclosed in U.S. Pat. No. 3,611,419, granted to the present applicant and also assigned to the assignee of this application. Printer head 12 induces on record medium 10 a latent electrostatic image of the intelligence to be recorded, in response to electrical signals from control module 13. Then, record medium 12 is drawn over a curved toner head 14 according to the present invention so that the latent image is developed. Toner liquid is drawn through toner head 14 from a reservoir 16 by means such as a vacuum pump 18. Partially depleted toner is then returned to reservoir 16 where it may be replenished, as indicated schematically at 20. Following toning, the wet, developed record medium is drawn over a curved clean-off head 22 according to the invention, which removes the excess toner by applying suction from pump 18. The essentially dry, developed record medium is then drawn away and made accessible for tearing off, cutting off, winding up, folding or the like, by means not shown.

FIGS. 2 to 5 illustrate the elements of toner head 14. An essentially U-shaped, elongated housing 24 is provided, which may be of any suitable material such as metal or plastic. The upper ends of the side walls 26 of housing 24 are cut away on their inner faces 28 to form a pair of parallel, coplanar mounting ledges 30. Just outboard of ledges 30 longitudinal slots 34,36 are provided which snugly receive outer wear elements or rails 38,40 which preferably are of hardened tool steel or the like to resist abrasion by the moving record medium 10. Rails 38,40 extend upwardly to the top edges of side walls 26. The opposite ends of housing 24 are closed by suitable end caps 42 secured by means such as screws 43. The open side of housing 24 is closed by a plurality of manifold modules 44*i* and 46*e* which rest on mounting ledges 30, as most clearly seen in FIGS. 4 and 5. Each module 44*i*, 46*e* includes a longitudinal slot 50 on its underside, into which a separator wall element or bulkhead 52 is inserted and fixed by suitable means such as epoxy cement (not shown). The lower end of bulkhead 52 is inserted into and fixed within a longitudinal slot 54 provided in the bottom of housing 24. Thus, housing 24 is partitioned by bulkhead 52 into an inlet plenum 56 and an outlet plenum 58, which respectively receive and discharge the liquid toner in use through ports 57 and 59 (also shown in phantom in FIG. 3), as will be more fully described subsequently.

Figures 2, 3:
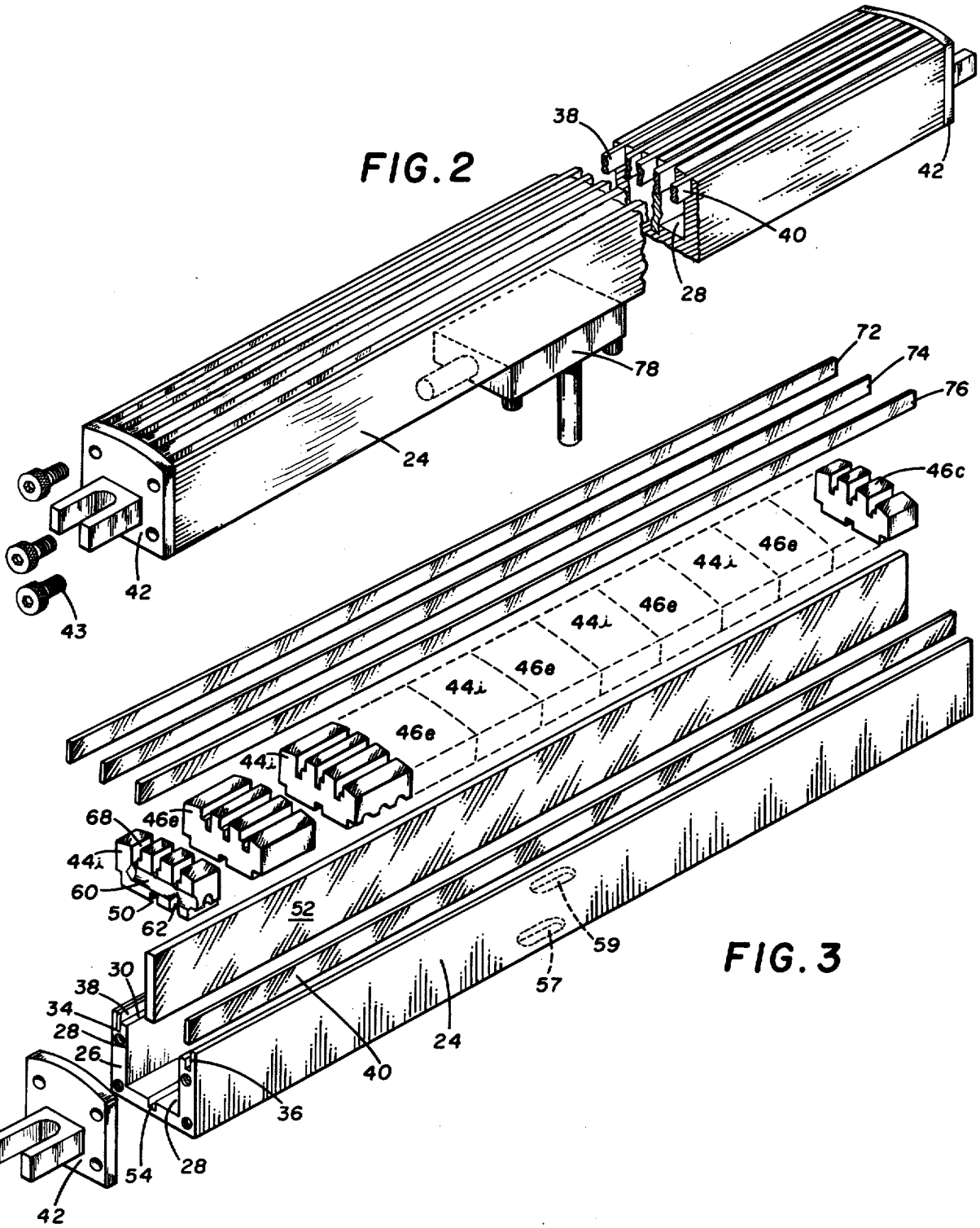
FIG. 2 shows a perspective view of one embodiment of the toning head according to the invention.
FIG. 3 shows an exploded perspective view of the toning head illustrated in FIG. 2.

Manifold modules 44*i*, 46*e* are identical in structure, but are mounted on ledges 30 in alternating, oppositely facing directions, as shown in FIG. 3. Each module comprises a block of metal such as aluminum, or other material such as an electrically conductive plastic, having several flow passages 60 extending laterally, partially therethrough, which intersect a corresponding plurality of downwardly extending ports 62. Ports 62 are positioned so that they will communicate with either inlet plenum 56 or outlet plenum 58, depending on which way the manifold modules 44*i*, 46*e* are oriented. The modules are narrower in width than the spacing between wear rails 38,40 so that narrow longitudinal channels 64,66 extend along either side of the modules.

The upper portion of each module 44*i*, 46*e* is provided with longitudinal slots 68, thus creating several counterelectrodes 47. Slots 68 extend downward and intersect with flow passages 60 to form flow communicating openings. Each slot 68 is stepped on one side wall near its bottom, but above passages 60, to provide clamping and sealing lands 70. Additional wear rails 72,74,76 are inserted into slots 68 and essentially centered therein by opposite sealing lands 70. Because the manifold modules are alternately faced in opposite directions, sealing lands 70 tend to hold wear rails 72,74,76 rigidly in position, as shown most clearly in FIGS. 4 and 5. Wear rails 72,74,76 cooperate with sealing lands 70 to partition each slot 68 into inlet and outlet passages by blocking off a portion of the openings to passages 60. As a result of the alternating orientation of the modules 44i, 46e, all openings into passages 60 that fall to one side of the wear rails are inlet passages, while openings falling to the opposite side are outlet passages.

Figure 4:
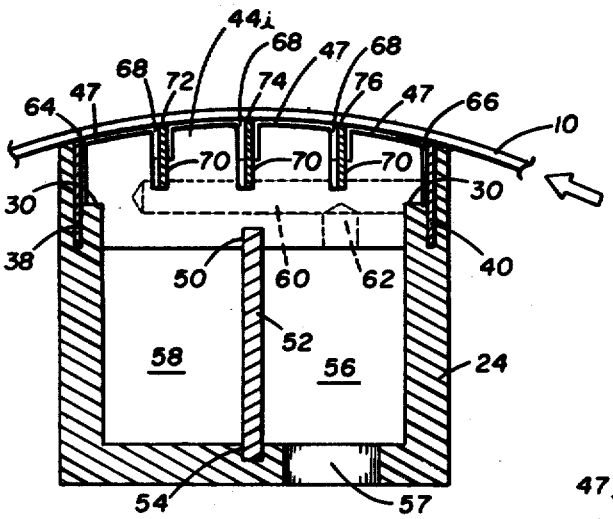
FIG. 4 shows a sectional view through the toning head of FIG. 1, illustrating one of the toning head modules oriented to receive toner from the inlet plenum.
Figure 5:
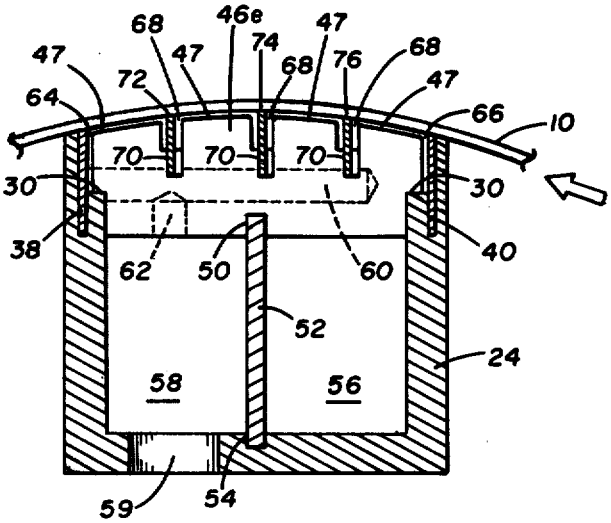
FIG. 5 shows a sectional view through the toning head of FIG. 1, illustrating one of the toning head modules oriented to return depleted toner liquid to the outlet plenum.

The outer edges or bearing surfaces of wear elements 38,40,72,74,76 project above the upper surface of manifold modules 44i, 46e to define a plurality of elongated, toning channels extending along toning head 14, the channels opening outwardly relative to inlet and outlet plenums 56,58. These outer bearing surfaces are situated at different heights, as shown in FIGS. 4 and 5, so that they comprise a portion of the geometrical elements of a theoretical cylindrical surface, over which the record medium is drawn while being supported in a cylindrically arched manner during toning. End caps 42 are shaped to conform to this geometry as well. In practice, approximately a two-inch radius of curvature has been found to be acceptable; however, other smooth, cylindrical configurations are within the scope of the invention. The upper surfaces of the manifold modules 44i, 46e make up a plurality of counterelectrodes 47 which are recessed slightly below the bearing surfaces of rails 38,40,72,74,76 to provide sufficient clearance for toner flow when the record medium is in place. To assure homogeneous flow conditions in the active toning zones, it is important that the dominant flow resistance within the toning head structure be produced at this point. Other advantages derived from the use of counterelectrodes stationed in close proximity to the image bearing side of the record medium are well known in the art.

The operation of toning head 14 may be understood from a study of FIGS. 4 and 5. Pump 18 is started after record medium 10 has been drawn over toning head 14 and clean-off head 22. Due to the curvature of heads 12 and 22, the record medium engages them closely so that the rather low vacuum drawn by pump 18, about 76 mm of mercury, causes a good seal to form between the heads and the record medium. Toner is drawn from reservoir 16, through intake port 57, into inlet plenum 56, then through ports 62 of modules 44i, upward into flow passages 60 which direct the flow of toner into the inlet passages extending up to the leading edges of counterelectrodes 47. Here the toner fans out along the lengthwise direction of the toning head to produce an essentially homogenous, uniformly flowing layer confined between the counterelectrodes 47, the record medium 10 and a pair of the wear rails. The latent image on the record medium is at least partially developed as the medium moves between adjacent wear rails. The outlet passages at the trailing edges of counterelectrodes 47 receive and guide the partially spent toner downward into passages 60 in the adjacent modules 46e. The return flow combines in plenum 58 through corresponding ports 62 and is drawn away through discharge port 59 to reservoir 16, through pump 18.

The width, depth and number of the several elongated, toning channels is dependent upon many parameters such as chart speed, toner liquid concentration, toner particle mobility, toner particle charge levels, the paper characteristics and other factors, as will be appreciated by those skilled in the art. Generally, each channel across the head is proportioned, as viewed in FIGS. 4 and 5, so that for the particular desired operating characteristics of the individual imaging system, the toner will not have totally depleted itself as it departs each active toning zone. Thus, the record medium is subjected serially to several elongated, toning zones or channels, each of which receives fresh toner at its lead edge and discharges partially depleted toner at its trailing edge. To ensure proper toning under these conditions, the average toner velocity near the record medium interface is preferably slightly larger than the paper speed. Although the paper is illustrated as moving in the same direction as the toner, which is the preferred mode of operation, those skilled in the art will appreciate that paper movement in the opposite direction also will work, though somewhat less efficiently.

In one actual embodiment of the invention, a commercially available liquid toner, such as type LX-25 made by the P. A. Hunt Chemical Corporation is pumped through the toning channels at about 45 ml/sec (0.7 gpm). Each elongated, toning channel is nominally 27 cm (10.6 inches) long between end caps 42, 0.43 cm (0.17 inch) wide and 0.9 mm (0.0035 inch) deep at counterelectrodes 47. Satisfactory toning was achieved on a variety of dielectric coated papers at speeds up to 25.4 cm/second (10 inches/second). A commercially available fuel pump such as Model P4594 made by the Carter Carburetor Division of ACF Industries, Inc. provided adequate flow through the system, creating a pressure drop of about 76 mm of mercury across the toning head.

Figure 6:
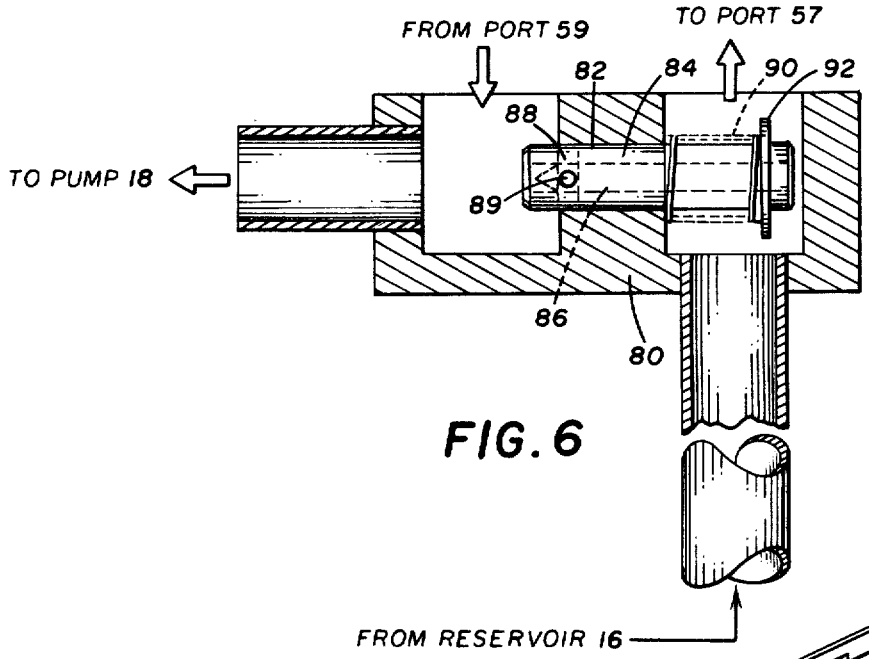
FIG. 6 shows a sectional view through the pressure control valve used in the invention.
Figure 7:
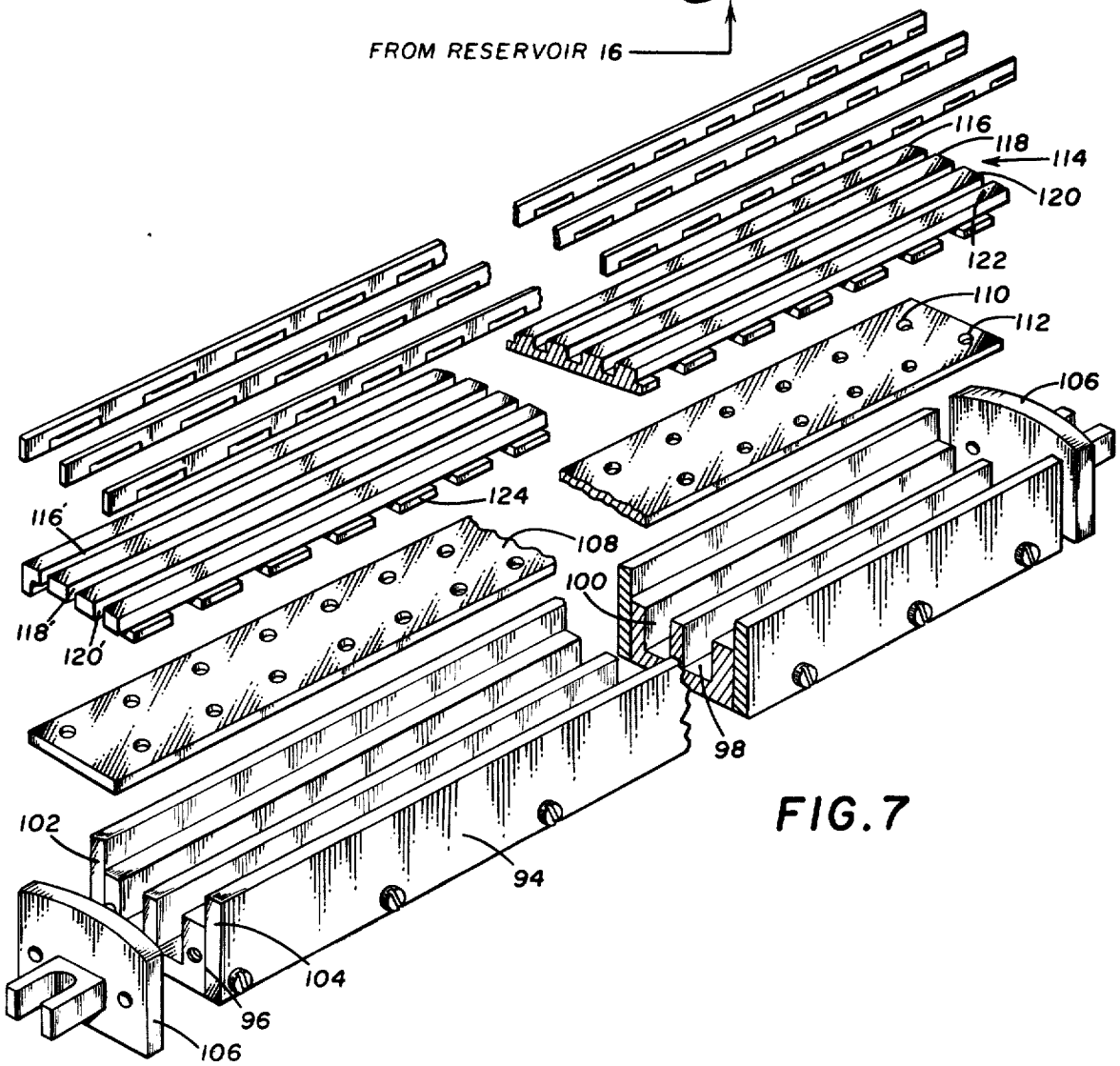
FIG. 7 shows an exploded, perspective view of another embodiment of the toning head according to the invention.

Because the toning system operates at subatmospheric pressure, difficulties can arise when attempting to begin movement of the record medium after even a relatively short period with the pump on. Particularly, during periods of stationary operation, the record medium may gradually deflect into the elongated, toning channels, due to the effect of outside atmospheric pressure on one side of the record medium and subatmospheric pressure on the other. As the clearance between the record medium and the counterelectrodes diminishes, the pressure differential increases. Accordingly, this condition can avalanche, leading to a deflecting force of such magnitude that the required separation between the record medium and the counterelectrodes cannot be restored simply by resuming forward movement of the record medium. To alleviate this problem, a simple bypass or relief valve is provided, as shown in FIG. 6. A valve housing 78 is provided which communicates with ports 57 and 59 on the bottom of housing 24. The interior of housing 78 is divided into inlet and outlet portions by a wall member 80. A bore 82 through wall member 80 receives a freely sliding piston 84 having a longitudinal bore 86 and intersecting radial bores 88,89 therethrough. Radial bores 88,89 are positioned so that when piston 84 is biased to the right by spring 90 acting on retainer 92, the bores will be blocked by the wall of bore 82, thereby preventing flow through bores 86 and 88, 89. When, however, the pressure on the outlet plenum side of wall member 80 drops below a predetermined level, the pressure differential across the wall will override the tension of spring 90 and cause piston 84 to move to the left, as illustrated, exposing bores 88,89 and thereby allowing toner liquid to flow through bores 86 and 88,89 and preventing an excessive pressure drop. In practice, the valve is preset to limit the pressure differential across the inlet and outlet ports to a peak value in the range of 72 to 83 mm of mercury (1.4 to 1.6 psi), when the actual embodiment previously discussed is used and inlet pressure is nearly atmospheric.

FIGS. 7 to 11 illustrate another embodiment of toner head 14, which functions in a very similar manner but has rather different structural features for doing so. An essentially U-shaped elongated housing 94 is provided, which may be of any suitable material such as metal or plastic. The base portion 96 of housing 94 comprises an elongated bottom wall portion having a pair of parallel, upward opening longitudinal slots or channels 98,100, for a purpose to be described. Channels 98,100 communicate with a pair of toner inlet and discharge ports 57a,59a, similar to ports 57 and 59 in FIG. 3, thereby defining toner inlet and outlet plenums. A pair of side walls 102,104 and end walls 106 complete the assembly of housing 94.

Figure 8:
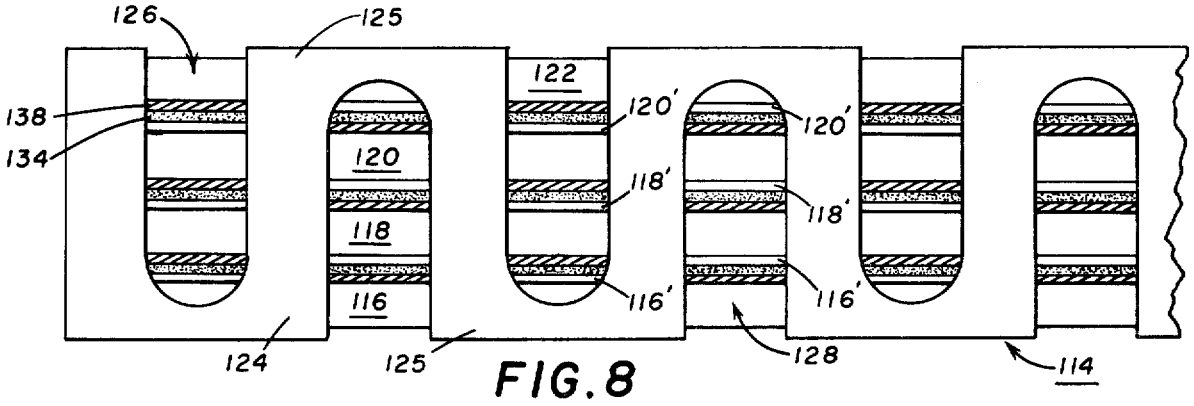
FIG. 8 shows a view of the underside of one of the elements of the embodiment illustrated in FIG. 7.

Resting on and suitably attached to the upper surface of base portion 96 is a thin manifold plate 108 having rows of staggered perforations 110,112 positioned to register with slots 98,100. See FIGS. 7, 10 and 11. Instead of the separate manifold modules 44i, 46e used in the embodiment of FIGS. 1 to 6, an elongated, unitized flow manifold 114 is preferred for this embodiment. Nonetheless, those skilled in the art will recognize that manifold 114 may be made in several sections, if desired. The upper portion of manifold 114 comprises a plurality of spaced, parallel, elongated counterelectrodes 116,118,120,122, separated by elongated slots 116',118',120'. The upper surfaces of counterelectrodes 116–122 form the bottoms of the toner flow channels, as seen most clearly in FIGS. 10 and 11. As shown in the underside view of FIG. 8 and the sectional views of FIGS. 10 and 11, these counterelectrodes 116–122 are supported by and preferably are formed integrally with, an undulating lower portion or manifold wall 124. As shown in FIG. 8, a view of a segment of the underside of manifold 114, wall 124 extends across beneath counterelectrodes 116–122 from one side to the other; then turns to form a U-shaped configuration; extends back across from the other side to the one side; and repeats this undulating pattern along the length of manifold 114. Wall 124 extends beyond the outer edges of counterelectrodes 116 and 122 to form sealing lands 125. Between the legs of the alternating U-shaped configurations, alternating oppositely facing inlet plenums 126 and outlet plenums 128 are formed which communicate with slots 116',118',120'. Plenums 126,128 also register with perforations 110,112 in manifold plate 108, respectively, when manifold 114 is inserted into housing 94 on top of plate 108 (see FIGS. 10 and 11). Thus, when elements 94,108 and 114 are assembled, toner from inlet plenum 98 branches into plenums 126 through perforations 110. Exhaust flow from plenums 128 is directed through perforations 112 into outlet plenum 100.

Figure 9:
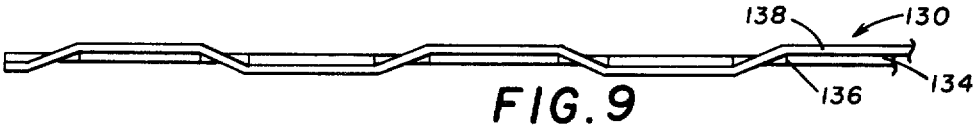
FIGS. 9 and 9*a* show bottom edge views of embodiments of the wear elements used in the toning head of FIG. 7.
Figure 9A:
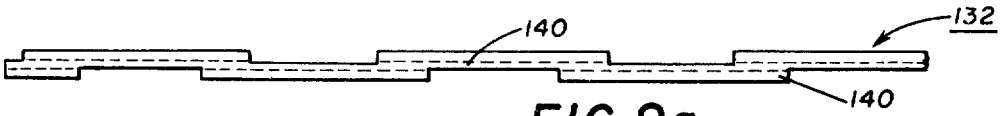

Since counterelectrodes 116–122 are separated by slots 116',118',120', flow between the counterelectrodes from inlet plenums 126 to outlet plenums 128 must be controlled to ensure adequate toner flow across the upper surfaces of the counterelectrodes. This control is achieved by elongated flow divider elements or rails 130 or 132, as illustrated in FIGS. 9 and 9a which are inserted into slots 116',118',120' to partition these slots into inlet and outlet passages. Rails 130, 132 also serve as wear elements between counterelectrodes 116–122 in a manner similar to elements 72–76 of FIG. 3. Rail 130 comprises a strip 134 of abrasion resistant material such as hardened tool steel, having longitudinally spaced cut-out portions 136 along its lower edge. Cut-out portions 136 correspond approximately in length and location to the legs of the alternating U-shaped configurations. A strip 138 of metal, such as aluminum, is woven through cut-out portions 136 in the manner depicted in the bottom edge view of FIG. 9. The combined thickness of rail 130 and 138 is chosen to provide a snug fit in slots 116',118',120'.

Figure 10:
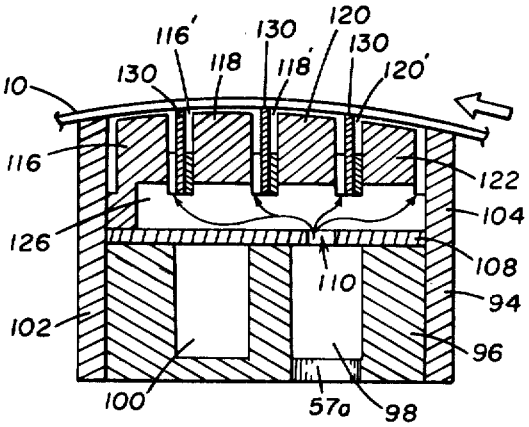
FIG. 10 shows a sectional view through the toning head of FIG. 7, illustrating the flow paths of toner from the inlet channels to the record medium.
Figure 11:
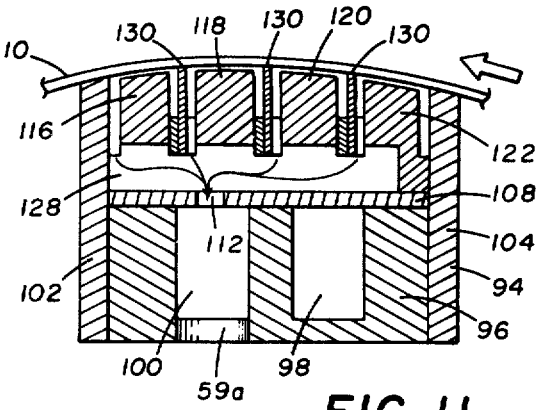
FIG. 11 shows a sectional view through the toning head of FIG. 7, illustrating the flow paths of toner to the outlet chamber from the record medium.

As illustrated in FIGS. 8, 10 and 11, strip 138 as it alternates from side to side of rail 130, seals off inlet passage from inlet plenums 126 that would otherwise communicate with the outlet flow passages at the trailing edges of counterelectrodes 116,118,120. Simultaneously, strip 138 seals off openings from outlet plenums 128 that would otherwise communicate with the inlet flow passages at the leading edges of the counterelectrodes 118,120,122. Thus, toner will be forced to pass over the tops of counterelectrodes 116–122 when flow is established with record medium 10 in place. Rail 132, as shown in the bottom view of FIG. 9a, has staggered pads 140 which extend upwardly to approximately the center of the rail. Those skilled in the art will appreciate that rail 132 may be interchanged with rail 130 to provide effectively identical results.

The tops of side walls 102,104, wear rails 130 or 132 and end caps 106 all project above the top surface of counterelectrodes 116–120 to define a plurality of elongated toning zones or channels extending along the toning head. As in the case of the embodiment of FIG. 2 and as shown in FIGS. 10 and 11, the outer bearing surfaces of rails 130 or 132, side walls 102,104 and end caps 106 comprise a portion of the geometrical elements of a theoretical cylindrical surface, over which the record medium is drawn while being supported in a cylindrically arched manner during toning.

The operation of this embodiment of toning head 14 may be understood from a study of FIGS. 10 and 11. Toner is drawn from reservoir 16, through inlet port 57a, into elongated slot 98, through perforations 110 and into inlet plenums 126. From there, it flows upward through the inlet slots formed along the leading edges of counterelectrodes 116–122 (left sides of wear elements 130 as viewed in FIG. 10 and between side wall 104 and counterelectrode 122). Here the toner fans out along the lengthwise direction of the toning head to produce an essentially homogeneous, uniformly flowing layer confined between the counterelectrodes 116–122, the record medium 10 and a pair of the wear rails. The latent image on the record medium is at least partially developed as the medium moves between adjacent wear rails. The outlet passages at the trailing edges of counterlelectrodes 116–122 receive and guide the partially spent toner downward into outlet plenums 128, and through perforations 112 into plenum 100, from which the toner is drawn away through discharge port 59a to reservoir 16, through pump 18. Preferably, a bypass valve as shown in FIG. 6 is also used with this embodiment of toner head 14. In general, though not specifically illustrated, the mating and abutting surfaces of the embodiments of the invention are bonded or sealed by a suitable agent such as various cements or solders.

Figure 12:
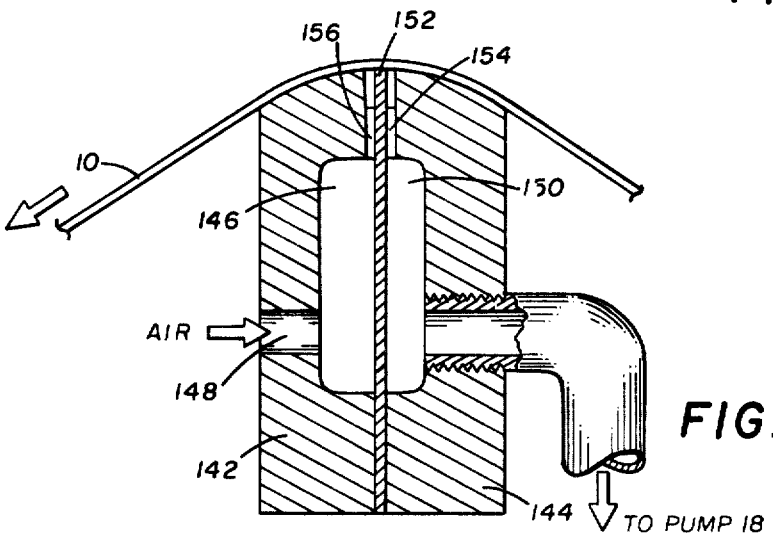
FIG. 12 illustrates an embodiment of the toner clean-off head according to the invention.

FIG. 12 shows a vertical section view through an embodiment of toner clean-off head 22. Housing halves 142,144 define an air inlet plenum 146 vented to atmosphere via passage 148; and an air and toner outlet plenum 150 connected to pump 18 via a suitable conduit. Plenums 146 and 150 extend across head 22 and are separated buy a clean-off blade 152 which extends upwardly through and is flush with the curved upper surface 154 of the clean-off head. Preferably surface 154 is cylindrically shaped as in the case of the toner heads previously discussed, with a radius of curvature of 1.25 to 2.5 cm. Clean-off blade 152 typically is about 0.25 mm (0.010 inch) thick and passes through to surface 154 with 0.25 mm (0.010 inch) flow passages on either side.

A plurality of opposing pads 156 rigidly support blade 152 near surface 154. In operation, the wet paper is drawn over the clean-off head in the direction indicated by the arrow. The curvature of surface 154 ensures proper sealing. Air drawn in through passage 148 rushes over the upper edge of blade 152, and entrains excess toner from the surface of the paper. The air and excess toner are then drawn away through outlet plenum 150 and returned to reservoir 16.

What is claimed is:

1. An improved toner head for applying liquid toner to a moving record medium having a latent electrostatic image thereon to be developed by the toner, comprising:

a housing having at least one inlet plenum for receiving liquid toner prior to at least partial development of said image and at least one outlet plenum for receiving liquid toner subsequent to at least partial development of said image;

manifold means communicating with said inlet and outlet plenums for directing flow of toner therebetween, said manifold means comprising a plurality of elongated, toning channels opening outwardly relative to said plenums;

a plurality of flow passages for directing liquid toner from said inlet plenum across the width of each of said elongated, toning channels and back to said outlet plenum; and a plurality of outwardly extending elongated wear elements, between said elongated, toning channels, said wear elements each having an outer edge, said outer edges together comprising a portion of the geometrical elements of a cylindrical surface over which a record medium is drawn during toning, said cylindrical surface thereby ensuring proper sealing contact of the record medium with said outer edges whereby toner flow across said elongated, toning channels is facilitated when a vacuum is applied to said outlet plenum.

2. An improved toner head according to claim 1, wherein said housing is elongated and has an essentially U-shaped cross-section with an open top for receiving said manifold means, and said inlet and outlet plenums are formed within said housing by an upwardly extending separator wall situated longitudinally within said housing.

3. An improved toner head according to claim 1, further comprising longitudinal flow channels on either side of at least some of said wear elements, said longitudinal flow channels communicating with said flow passages.

4. An improved toner head according to claim 1, wherein said housing is elongated and has an essentially U-shaped cross-section with an open top, said inlet and outlet plenums being formed by elongated recesses in the bottom of said housing.

5. An improved toner head for applying liquid toner to a moving record medium having a latent electrostatic image thereon to be developed by the toner, comprising:

a housing having at least one inlet plenum for receiving liquid toner prior to at least partial development of said image and at least one outlet plenum for receiving liquid toner subsequent to at least partial development of said image;

manifold means communicating with said inlet and outlet plenums for directing the flow therebetween, said manifold means comprising a plurality of adjacent manifold modules which have a plurality of elongated, toning channels opening outwardly relative to said plenums, said plurality of manifold modules being arranged in oppositely facing, alternating succession so that the elongated, toning channels of all are aligned but the ports of essentially half of said modules communicate with said inlet plenum, whereas, the ports of the alternating remainder of said modules communicate with said outlet plenum;

a plurality of flow passages for directing liquid toner from said inlet plenum across the width of each of said elongated, toning channels and back to said outlet plenum; and a plurality of outwardly extending elongated wear elements, between said elongated, toning channels, said wear elements each having an outer edge, said outer edges together comprising a portion of the geometrical elements of a cylindrical surface over which a record medium is drawn during toning, said cylindrical surface thereby ensuring proper sealing contact of the record medium with said outer edges whereby toner flow across said elongated, toning channels is facilitated when a vacuum is applied to said outlet plenum.

6. An improved toner head for applying liquid toner to a moving record medium having a latent electrostatic image thereon to be developed by the toner, comprising:

a housing having at least one inlet plenum for receiving liquid toner prior to at least partial development of said image and at least one outlet plenum for receiving liquid toner subsequent to at least partial development of said image;

manifold means communicating with said inlet and outlet plenums for directing flow of toner therebetween, said manifold means comprising a plurality of elongated, toning channels opening outwardly relative to said plenums;

a plurality of flow passages for directing liquid toner from said inlet plenum across the width of each of said elongated, toning channels and back to said outlet plenum;

a plurality of outwardly extending, elongated wear elements, each having an outer edge, said outer edges together comprising a portion of the geometrical elements of a cylindrical surface over which a record medium is drawn during toning, said cylindrical surface thereby ensuring proper sealing contact of the record medium with said outer edges whereby toner flow across said elongated, toning channels is facilitated when a vacuum is applied to said outlet plenum; and a relief valve means interconnecting said inlet and outlet plenums for permitting flow to bypass said plenums when the pressure in said outlet plenum drops to a preselected level.

7. An improved toner head for applying liquid toner to a moving record medium having a latent electrostatic image thereon to be developed by the toner, comprising:

a housing having at least one inlet plenum for receiving liquid toner prior to at least partial development of said image and at least one outlet plenum for receiving liquid toner subsequent to at least partial development of said image;

manifold means communicating with said inlet and outlet plenums for directing flow of toner therebetween, said manifold means comprising a plurality of elongated, toning channels opening outwardly relative to said plenums, said manifold means further comprising a plate bridging both said inlet and said outlet plenums, said plate having staggered ports along the length thereof for communicating alternately with said inlet and outlet plenums, a flow manifold superposed on said plate, said flow manifold having alternating inlet and outlet plenums respectively in flow-through relationship with said staggered ports communicating with said inlet and outlet plenums, a plurality of laterally spaced, elongated counterelectrodes superposed on said flow manifold to form the bottom of said elongated, toning channels;

a plurality of flow passages for directing liquid toner from said inlet plenum across the width of each of said elongated, toning channels and back to said outlet plenum; and a plurality of outwardly extending, elongated wear elements, between said elongated, toning channels, said wear elements each having an outer edge, said outer edges together comprising a portion of the geometrical elements of a cylindrical surface over which a record medium is drawn during toning, said cylindrical surface thereby ensuring proper sealing contact of the record medium with said outer edges whereby toner flow across said elongated, toning channels is facilitated when a vacuum is applied to said outlet plenum, and wherein said wear elements are located between said elongated counterelectrodes, said wear elements further comprising means spaced therealong for blocking flow to one side while permitting flow to the other side of said wear elements from said plenums, and for blocking flow from said other side while permitting flow from said one side of said wear elements to said plenums.

* * * * *